US006135849A

United States Patent [19]

Yamada

[11] Patent Number: 6,135,849

[45] Date of Patent: Oct. 24, 2000

[54] TOY GIVING OFF SOUND

[75] Inventor: Yumi Yamada, Tokyo, Japan

[73] Assignee: Tomy Company, Ltd., Tokyo, Japan

[21] Appl. No.: 09/219,339

[22] Filed: Dec. 23, 1998

[30] Foreign Application Priority Data

Jun. 10, 1998 [JP] Japan ..... 10-004127

[51] Int. Cl.[7] ..... A63H 3/28

[52] U.S. Cl. ..... 446/397; 496/397

[58] Field of Search ..... 446/397, 408, 446/299, 302, 404; 496/297

[56] References Cited

U.S. PATENT DOCUMENTS 5,382,188 1/1995 Tomellini ..... 446/397
5,679,049 10/1997 Arad et al. ..... 446/408

*Primary Examiner*—Sam Rimell
*Attorney, Agent, or Firm*—Nixon & Vanderhye P.C.

[57] ABSTRACT

A toy giving off sound includes a body having a size which can be clasped in a hand, a turntable provided on the body to be rotated by a tip of a finger, and a sound generating member for generating a sound accompanied with an operation of rotating the turntable. The toy can be used for various ways of play to generate a sound.

8 Claims, 2 Drawing Sheets

TOY GIVING OFF SOUND

BACKGROUND OF THE INVENTION

1. Field of the Invention

The present invention relates to a toy giving off sound and, in particular, a toy having functions of recording and playback.

2. Description of the Related Art

As a toy giving off sound, which is suitably handy to carry, having functions of recording and playback has been known. With the toy giving off sound, short words received by a microphone or the like are recorded by pressing a recording button, and the words are played back in spelling order or backward over a speaker by pressing a playback button.

However, with the above-described toy giving off sound, a problem arises in that using the toy is limited because the recorded words or the like are only played back as they are, and a user can not control how the recorded sounds are played.

SUMMARY OF THE INVENTION

The present invention was developed in view of this problem.

An object of the present invention is to provide a toy giving off sound which can be used for various ways of play to generate a sound.

In order to accomplish the above-described object, in one aspect of the present invention, a toy giving off sound comprises: includes a body having a size which can be clasped in a hand; a turntable provided on the body and rotated by a tip of a finger; and a sound generating member for generating a sound accompanied with rotating the turntable.

The sound generating member may include a member which can generate a sound; for example, a tape recorder, an electronic circuit member, or the like.

According to the toy giving off sound of the invention, for example, a sound is generated by that the body being clasped in one hand and the turntable being rotated by the tip of a finger of the other hand. As a result, because the sound is generated from the sound generating member by rotating the turntable, it is superior in operational performance.

The sound generating member may include an actuating switch for being actuated accompanied with a rotation of the turntable; an electronic circuit member for outputting a sound signal when the actuating switch is actuated; and a speaker for generating a sound corresponding to the sound signal.

In this case, an IC, an LSI or the like may be used for the electronic circuit member.

The sound signal may be outputted from the determined electronic circuit member when the actuating switch is actuated, so that the sound corresponding to the sound signal is generated over the speaker. Therefore, by using the electronic circuit member, it may be possible to miniaturize and lighten the toy.

The actuating switch may comprise a function of a power supply switch. Thus, because the actuating switch may have the function of the power supply switch, it may be possible to decrease the number of members.

The turntable may comprise a shape of a record disc. In this context, because the turntable may have the same shape as the shape of the record disc, it may be possible to feel as if the user rotated a real record.

The body may comprise a sound selector for selecting the sound. The, the sound may be changed when the sound selector is operated. As a result of this, it may be possible to hear various sounds by selecting the sound.

The turntable can be reversibly rotated, making it possible to continuously generate the sound by repeating the clockwise and counter clockwise rotations of the turntable and to enjoy feeling as if the user were a turntable disc jockey.

When the second actuation of the actuating switch is carried out within a definite time from the first actuation, the sound generation by the first actuation may be stopped and a sound may be generated by the second actuation. It may thus be possible to enjoy various sounds.

BRIEF DESCRIPTION OF THE DRAWINGS

The present invention will become more fully understood from the detailed description given hereinbelow and the accompanying drawings which are given by way of illustration only, and thus which are not intended as a definition of the limits of the present invention, and wherein.

PREFERRED EMBODIMENT OF THE INVENTION

An embodiment of the toy giving off sound in accordance with the present invention will be explained in detail with reference to FIGS. 1 to 3.

Figure 1:
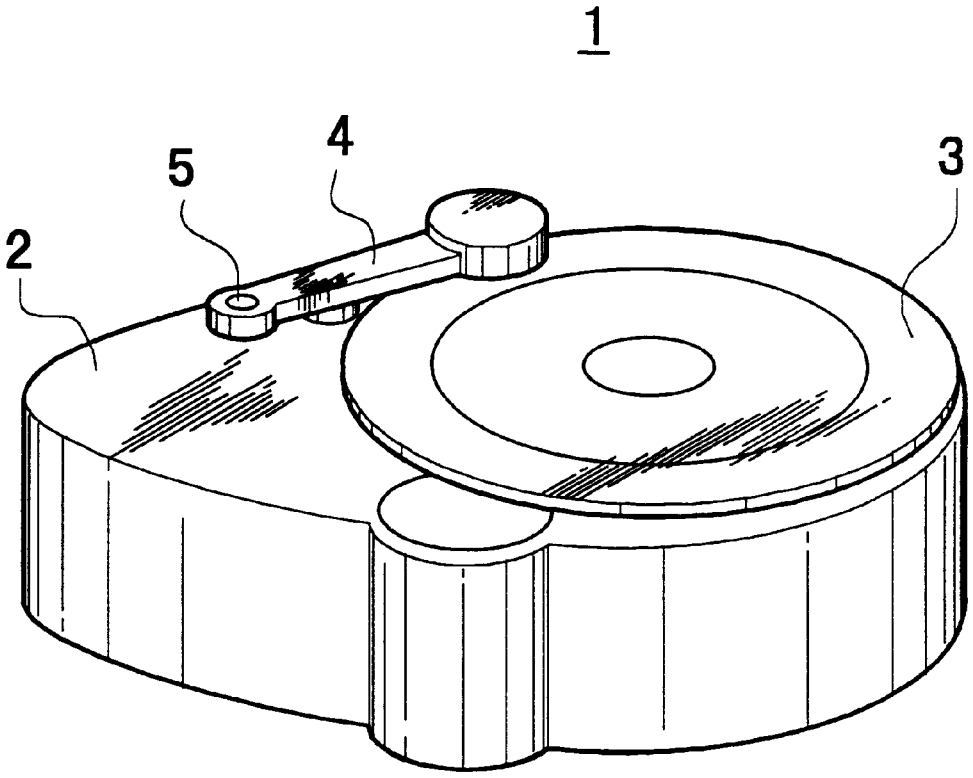
FIG. 1 is a perspective view of a toy giving off sound according to the embodiment of the present invention.

FIG. 1 shows the toy giving off sound according to the embodiment of the present invention. A body 2 of the toy 1 giving off sound has a size which can be clasped in a hand. On an upper surface of the body 2, a turntable 3 is provided to be rotatable and can be rotated by the tip of a finger. The turntable 3 is formed to have a shape of a record disc. On the upper surface of the body 2, a fixed arm 4 is provided next to the turntable 3. A base portion of the fixed arm 4 is fixed to the body 2 at an outside position of the turntable 3, and a top end portion of the fixed arm 4 is extended above a peripheral portion of the turntable 3. The top end of the fixed arm 4 is shaped like a circle. The fixed arm 4 imitates a sound pickup of a record player, so that the toy 1 giving off sound looks like a record player as a whole.

On the base portion of the fixed arm 4, a pushbutton 5 is provided.

Further, a battery container 6 is provided in the body 2. In the battery container 6, it is possible to place a battery as a power supply, e.g., a micro cell which is not shown.

Next, an internal structure of the toy 1 giving off sound will be explained.

Figure 2:
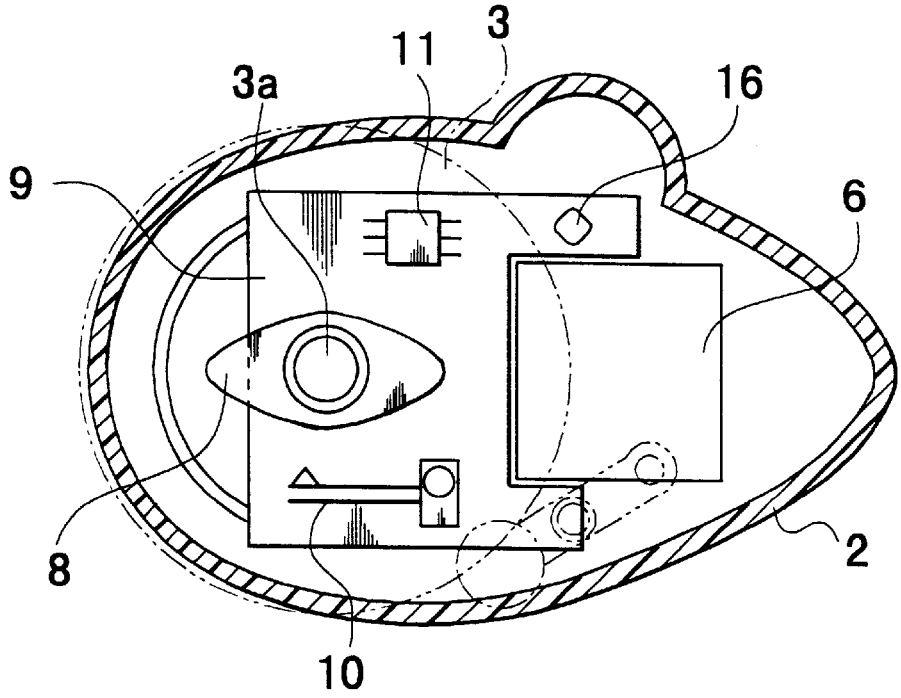
FIG. 2 is a transverse sectional view showing the toy giving off sound according to the embodiment of the present invention from a bottom side of the toy.
Figure 3:
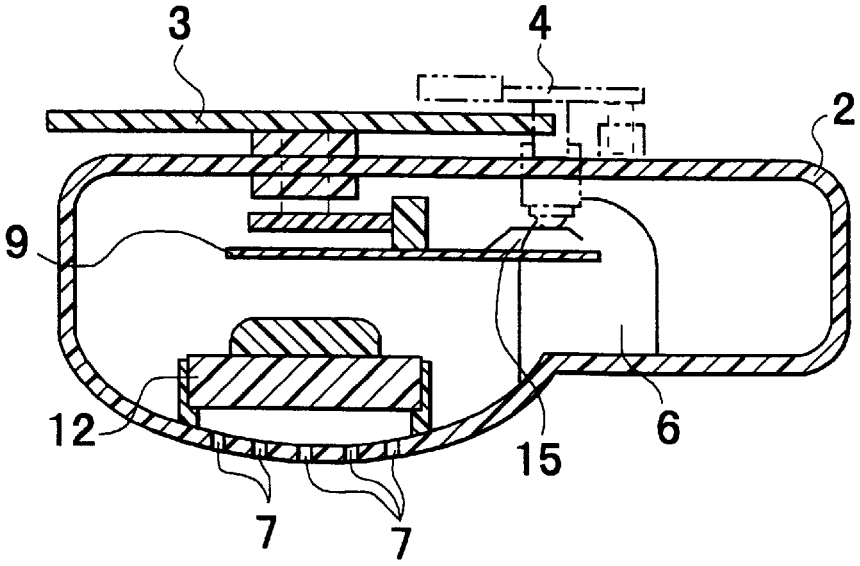
FIG. 3 is a vertical sectional view showing the toy giving off sound as shown in FIG. 1 from a front side of the toy.

An axis 3*a* of the turntable 3 is extended inside the body 2, and a contacting member 8 which is diamond-shaped is attached to an extended portion of the axis 3*a* inside the body 2, as shown in FIG. 2. The contacting member 8 is rotated with the rotating of the turntable 3. An actuating switch 10 is provided on a printed wiring board 9 which is provided inside the body 2. The actuating switch 10 has a function of a power supply switch. When the turntable 3 is rotated and a corner portion of the contacting member 8 is brought into contact with the actuating switch 10, power is supplied. When power is supplied, the sound synthesizing program of an electronic circuit member 11 described later is executed, and the electronic circuit member 11 outputs a sound signal so that the sound is generated. When the predetermined sound is generated and finished, the power is turned off. When a second actuation of the actuating switch 10 is carried out within a time when the sound generation is finished (that is, before the power is turned off from a first actuation), the sound generation by the first actuation is stopped and the sound is generated by the second actuation.

The pushbutton 5 is connected with a sound selector 15. The sound selector 15 is electrically connected with the electronic circuit member 11. When the pushbutton 5 is pushed and the sound selector 15 is operated, a sound selecting program of the electronic circuit member 11 is executed so that the sound is changed.

The electronic circuit member 11, e.g., an IC, an LSI and the like, which outputs a sound signal is provided on a printed wiring board 9. The electronic circuit member 11 is electrically connected with the actuating switch 10. The electronic circuit member 11 is programmed in advance to synthesize a predetermined sound and to output the sound signal when the power is supplied by actuating the actuating switch 10. Therefore, when the turntable 3 is rotated and the corner portion of the contacting member 8 is brought into contact with the actuating switch 10, the actuating switch 10 is actuated, power is supplied to the electronic circuit member 11, the sound synthesizing program of the electronic circuit member 11 is executed to synthesize the sound, and the sound signal is outputted from the electronic circuit member 11 which is electrically connected to the actuating switch 10. As a result, the sound is generated. The electronic circuit member 11 is electrically connected with the sound selector 15 and programmed in advance to change the sound when the sound selector 15 is operated. Therefore, when the pushbutton 5 is pushed, the sound selector 15 is operated, the sound selecting program of the electronic circuit member 11 is executed, and the sound selecting signal is outputted from the electronic circuit member 11. As a result, the sound is changed. The sound selecting program may be programmed to change the tone of the sound, a musical scale thereof, a rhythm thereof, a melody thereof, a word or the like. On the printed wiring board 9, a resistance, a condenser, a transistor, or the like is provided as needed. A speaker 12 is provided on a side under the printed wiring board 9, as shown in FIG. 3. The speaker 12 is electrically connected with the electronic circuit member 11. When the sound signal is outputted from the electronic circuit member 11, the sound is generated over the speaker 12. A cone side of the speaker 12 is disposed facing sound holes 7. The sound generated over the speaker 12 is given off through the giving off sound holes 7 in the body 2.

The power supply switch and the actuating switch 10 may be separately provided on the toy 1. The sound generating member comprises the actuating switch 10, the electronic circuit member 11, and the speaker 12.

A way of using the toy 1 giving off sound will be explained as follows.

First, the user clasps the toy 1 by one's left hand for example, and puts one's index finger of one's right hand on the turntable 3 to rotate the turntable 3. As a result, the corner portion of the contacting member 8 is brought into contact with the actuating switch 10, the actuating switch 10 is actuated, power is supplied, the sound synthesizing program of the electronic circuit member 11 is executed, the sound is synthesized, the electronic circuit member 11 outputs the sound signal, and the sound is outputted through sound holes 7, as shown in FIG. 3, which is provided on a back side of the body 2. In this case, the user may rotate the turntable 3 little by little clockwise and counter-clockwise as well as by rotating the turntable 3 in one direction. As a result, because the actuating switch 10 is actuated little by little, the sound is outputted little by little. For example, with the toy 1 giving off sound which generates the sound track "good morning", the toy 1 repeats to generate the sound as follows, "good morning", "good", "good mor", "good mor", "good", and "goo", for example. While the toy 1 giving off sound is generating the sound, a luminescent semiconductor diode 16 flashes on and off.

According to the toy 1 giving off sound, because the sound is generated by operation of rotating the turntable 3, it is superior in operational performance compared to a case that the sound is generated by pushing a button or the like. Because of the electronic circuit member 11, it is possible to miniaturize and lighten the toy 1 in weight compared to a case that a tape recorder or the like is used.

Moreover, because the turntable 3 has the same shape as the shape of the record disc, it is possible to feel as if the user rotated a real record. Further, the sound is changed when the sound selector is operated by pushing the pushbutton 5. As a result, it is possible to hear various sounds.

Still further, because the turntable 3 is reversibly rotated, it is possible to continuously generate the sound by repeating the clockwise and counter-clockwise rotation of the turntable 3 and to enjoy to feel as if the user were a turntable disc jockey. Additionally, because the sound is outputted one after another during the operation of rotating the turntable 3, it is possible to enjoy various sounds.

The present invention is not limited to the above-described embodiment. Obviously, many modifications and variations of the present invention in light of the above teaching may be made. It is, therefore, to be understood that, within the scope of the appended claims, the invention may be practiced otherwise than as specifically described.

For example, although in the above-described embodiment, one melody, one word, or the like is outputted repeatedly, it can play one melody, one word or the like as a whole by synthesizing each single sound one after another and outputting them based on a program previously memorized in the electronic circuit member 11.

According to the above-described embodiment, the sound is outputted by rotating the turntable 3 based on the program previously memorized on the electronic circuit member 11. However, it is not limited to this. A recording button which is electrically connected with the electronic circuit member 11 may be provided, and the electronic circuit member 11 may be programmed in advance so that short words received by a microphone or the like may be recorded by pressing the recording button. Then, the words or the like are recorded and played back by rotating the turntable 3 as in the above-described embodiment.

In this case, it is preferable to program the electronic circuit member 11 so that a plurality of words or the like can be independently recorded; so that for example, the user can select one of them by pushing the pushbutton 5 and operating the sound selector 15 when the words or the like are played back. Further, it is preferable to program the electronic circuit device 11 so that the recorded contents can be freely eliminated.

One of the effects according to the toy giving off sound of the present invention is that, because the toy comprises the body having the size of which can be clasped in a hand, a turntable provided on the body and rotated by the tip of a finger, and a sound generating member for generating a sound accompanied with an operation of rotating the turntable, it is possible to provide an interesting toy giving off sound.

The entire disclosure of Japanese Utility Model Application No. 10-4127 filed on Jun. 10, 1998 including specification, claims, drawings and summary are incorporated herein by reference in its entirety.

What is claimed is:

1. A toy giving off sound comprising:

a body having a size which can be clasped in a hand;

a turntable provided on the body and having a shape of a record disk, the turntable being operated to be rotated by a tip of a finger; and a sound generating member for generating a sound accompanied with an operation of rotating the turntable, the sound generating member having an actuating switch that is actuated with a rotation of the turntable, an electronic circuit member that outputs a sound signal when the actuating switch is actuated, and a speaker that generates a sound corresponding to the sound signal, wherein a sound is generated by a first actuation of the actuating switch, and thereafter, when a second actuation of the actuating switch is carried out within a definite time from the first actuation, the sound generated by the first actuation is stopped and a sound having the same content as the sound generated by the first actuation is started.

2. A toy giving off sound as claimed in claim 1, wherein the actuating switch comprises a function of a power supply switch.

3. A toy giving off sound as claimed in claim 1, wherein the body comprises a sound selector for selecting sounds.

4. A toy giving off sound as claimed in claim 3, wherein the body comprises a sound selector for selecting the sounds.

5. A toy giving off sound as claimed in claim 1, wherein the turntable is rotatable in a clockwise direction and a counter-clockwise direction.

6. A toy giving off sound as claimed in claim 2, wherein the turntable is rotatable in a clockwise direction and a counter-clockwise direction.

7. A toy giving off sound comprising:

a body having a size which can be clasped in a hand;

a turntable provided on the body and having a shape of a record disk, the turntable being operated to be rotated by a tip of a finger; and a sound generating member for generating a sound accompanied with an operation of rotating the turntable, the sound generating member having a single actuating switch that is actuated with a rotation of the turntable, an electronic circuit member that outputs a sound signal when the single actuating switch is actuated, and a speaker that generates a sound corresponding to the sound signal, wherein a sound generation is started by one actuation of the single actuating switch, and thereafter, when another actuation of the single actuating switch is carried out during the sound generation by the one actuation, the sound generation by the one actuation is stopped and another sound generation is started by the another actuation.

8. A toy giving off sound as claimed in claim 7, further comprising a single contacting member connected to the turntable to actuate the single actuating switch, the single actuating switch being actuated when the single contacting member is brought into contact with the single actuating switch by the rotation of the turntable to generate a sound.

* * * * *